US010207891B1

(12) United States Patent
Bigbee, Jr. et al.

(10) Patent No.: US 10,207,891 B1
(45) Date of Patent: Feb. 19, 2019

(54) POWER DRIVEN CIRCUIT WIRE BOX

(71) Applicant: ENCORE WIRE CORPORATION, McKinney, TX (US)

(72) Inventors: William T. Bigbee, Jr., Melissa, TX (US); John L. Rhoads, The Colony, TX (US); Andrew P. Hull, McKinney, TX (US)

(73) Assignee: Encore Wire Corporation, McKinney, TX (US)

( * ) Notice: Subject to any disclaimer, the term of this patent is extended or adjusted under 35 U.S.C. 154(b) by 0 days.

(21) Appl. No.: 15/394,443

(22) Filed: Dec. 29, 2016

Related U.S. Application Data

(60) Provisional application No. 62/273,939, filed on Dec. 31, 2015.

(51) Int. Cl.
*B65H 75/30* (2006.01)
*B65H 75/40* (2006.01)

(52) U.S. Cl.
CPC ..... *B65H 75/305* (2013.01); *B65H 75/40* (2013.01); *B65H 2701/34* (2013.01)

(58) Field of Classification Search
CPC ..... B65H 75/40; B65H 75/4471; B65H 75/4481; B65H 75/4486; B65H 75/305; B65H 2701/34
See application file for complete search history.

(56) References Cited

U.S. PATENT DOCUMENTS

| | | | | |
|---|---|---|---|---|
| 6,065,710 | A * | 5/2000 | Richter | A61B 6/56 191/12.2 R |
| 6,361,021 | B1 * | 3/2002 | Brennan | B65H 75/305 254/134.3 FT |
| 2002/0005451 | A1 * | 1/2002 | Valverde | B63B 35/816 242/390.2 |
| 2008/0023579 | A1 * | 1/2008 | Leonard | B65H 75/22 242/390.8 |

* cited by examiner

*Primary Examiner* — William E Dondero
(74) *Attorney, Agent, or Firm* — Warren Rhoades LLP

(57) ABSTRACT

An apparatus for the dispensing and retraction of wire or cable. The apparatus including a first and second plate, at least one shaft attached to the first plate and the second plate, a spool gear attached to the shaft, a power gear shaft attached to the first or second plate, and a power gear attached to the power gear shaft and in mesh with the spool gear, wherein when the power gear is rotated, the spool gear is rotated.

22 Claims, 8 Drawing Sheets

POWER DRIVEN CIRCUIT WIRE BOX

CROSS-REFERENCE TO RELATED APPLICATIONS

This application claims priority benefit to U.S. Provisional Patent Application No. 62/273,939, filed Dec. 31, 2015 which is fully incorporated by reference herein.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The present invention relates in general to electrical wire and cable, and more particularly, to the systems and apparatus for the dispensing and retracting electrical wire and cable.

2. Description of Related Art

Wooden reels or plastic and metal spools are common in the wire and cable industry for delivery and dispensing circuit-size wire. Once wound, the reels and spools are distributed to customers and jobsites. On these reels and spools, the wire is removed or paid off in a last on/first off format. Reels and spools often require jack stands and a shaft to support the reel or spool during pay-off. The customer must transport and use this additional equipment when dispensing wire or cable from the reel or spool. During payoff, the inertia of the reel or spool may cause the reel or spool to continue to rotate after pulling has ceased, causing "overruns" which increase the risk of tangles and snags and additional damage to the wire or cable.

Typically upon completion of the wire installation, the operator manually wraps any excess dispensed wire back on to the spool. The operator typically uses his hands to rotate the spool on the shaft and ties the end of the wire to the spool to secure it upon completion. The operator is only capable of manually retracting one spool at a time. Also, the weight of the spool may be significant because of the amount of wire, including the metal conductors, remaining on the spool and the operator may encounter difficulty in spinning the spool for retracting the excess wire. Furthermore, some wire is delivered in coil form in boxes where it is difficult to re-spool manually as it requires pushing the wire back into the box. When pushing the wire back into the box manually, the coil loses is form and neatness and may bind or provide other difficulties when the remaining wire is subsequently dispensed. Additionally, boxed coils are often made of an opaque material such as cardboard, thus the operator cannot view the retraction progress within the box and therefore may be unaware of tangles or other issues that would prevent easy dispersing of the remaining wire.

According to a prior art method of distributing wire on spools, the spools are typically packaged in boxes or as single entities and they must be transferred to a shaft or a rack with multiple shafts at the installation site. This prior art method requires the operator to spend significant preparation time prior to the dispensing of the wire. Also, common racks for multiple spools often require several spools to be on the same shaft so that removing just one spool may require the removal of multiple spools.

One prior art method to solve the problem of having multiple spools on the same shaft is a "wire tree." In this design, the rack used to hold and transport the spools substitutes a single shaft with multiple short spindles, each capable of holding a single spool. While this offers a solution for removing individual spools easily, it is just as heavy and difficult to transport as a traditional rack, and requires the same manual wire retraction as the other prior art.

BRIEF SUMMARY OF THE INVENTION

The present invention provides for the use of power driven circuit wire box for the dispensing and retraction of wire or cable. The power driven circuit wire box is powered with power tools to spin the reel in forward or backwards direction, thus promoting the dispensing and retraction of the wire or cable. The power tool connects to a power gear which is in mesh with a spool gear attached to the wire or cable spool. As the power tool rotates the power gear, the power gear rotates the spool gear and the spool. The power driven circuit wire box may be manufactured from transparent materials which allow the operator to view the wire being dispensed and retracted in the power driven circuit wire box. The power driven circuit wire box is advantageous in that multiple spools are packaged already on shafts in a low form-factor package that does not occupy much more volume than the spools themselves. Further, each spool has its own shaft so that it can be removed or exchanged independently of the other spools.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

DETAILED DESCRIPTION OF THE PREFERRED EMBODIMENT

Figure 1A:
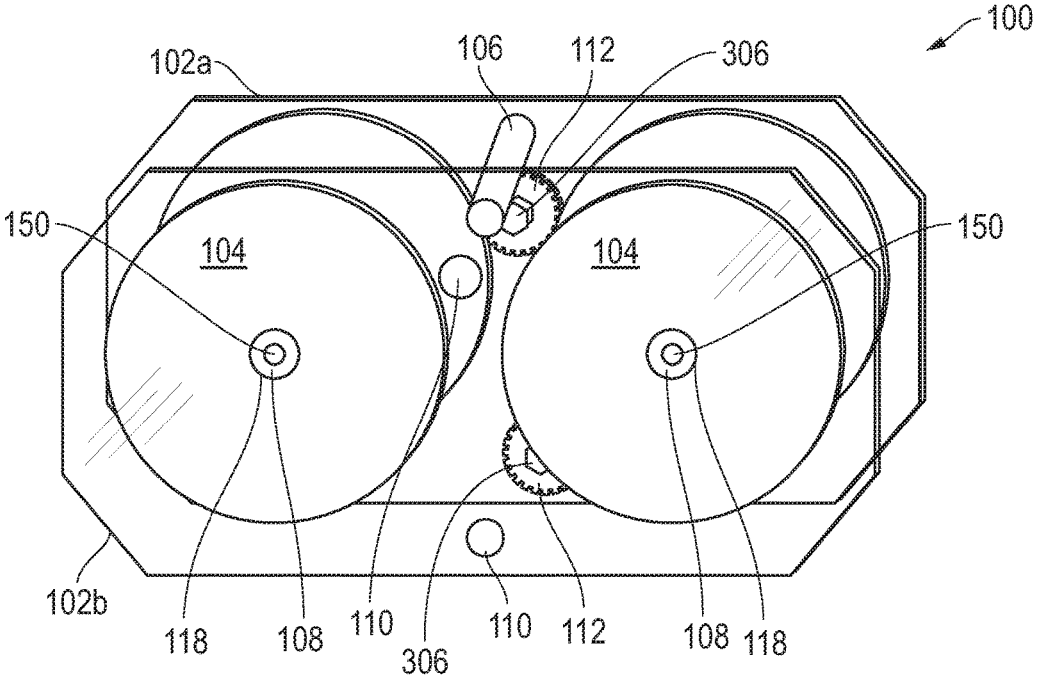
FIGS. 1A-1C are perspective views of a power driven circuit wire boxes according to embodiments of the invention.
Figure 1B:
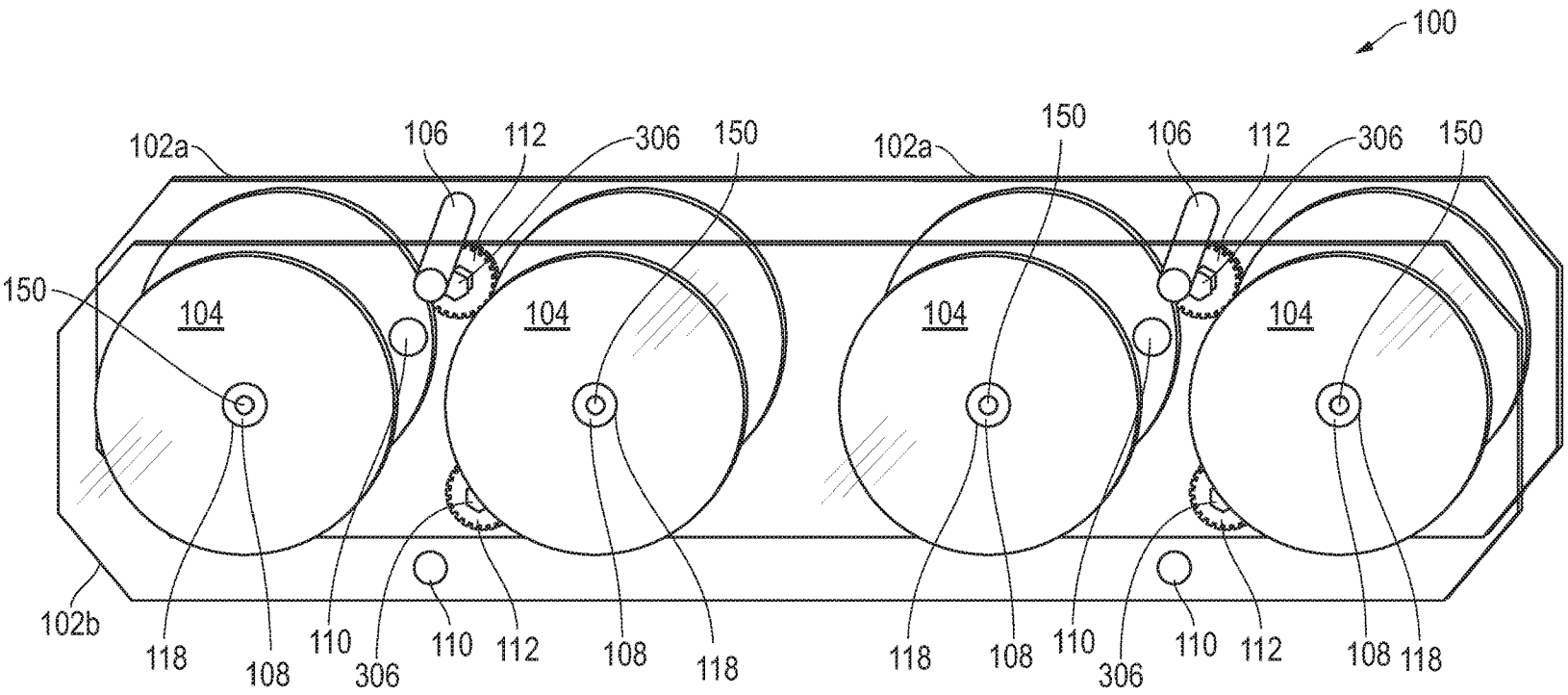
Figure 1C:
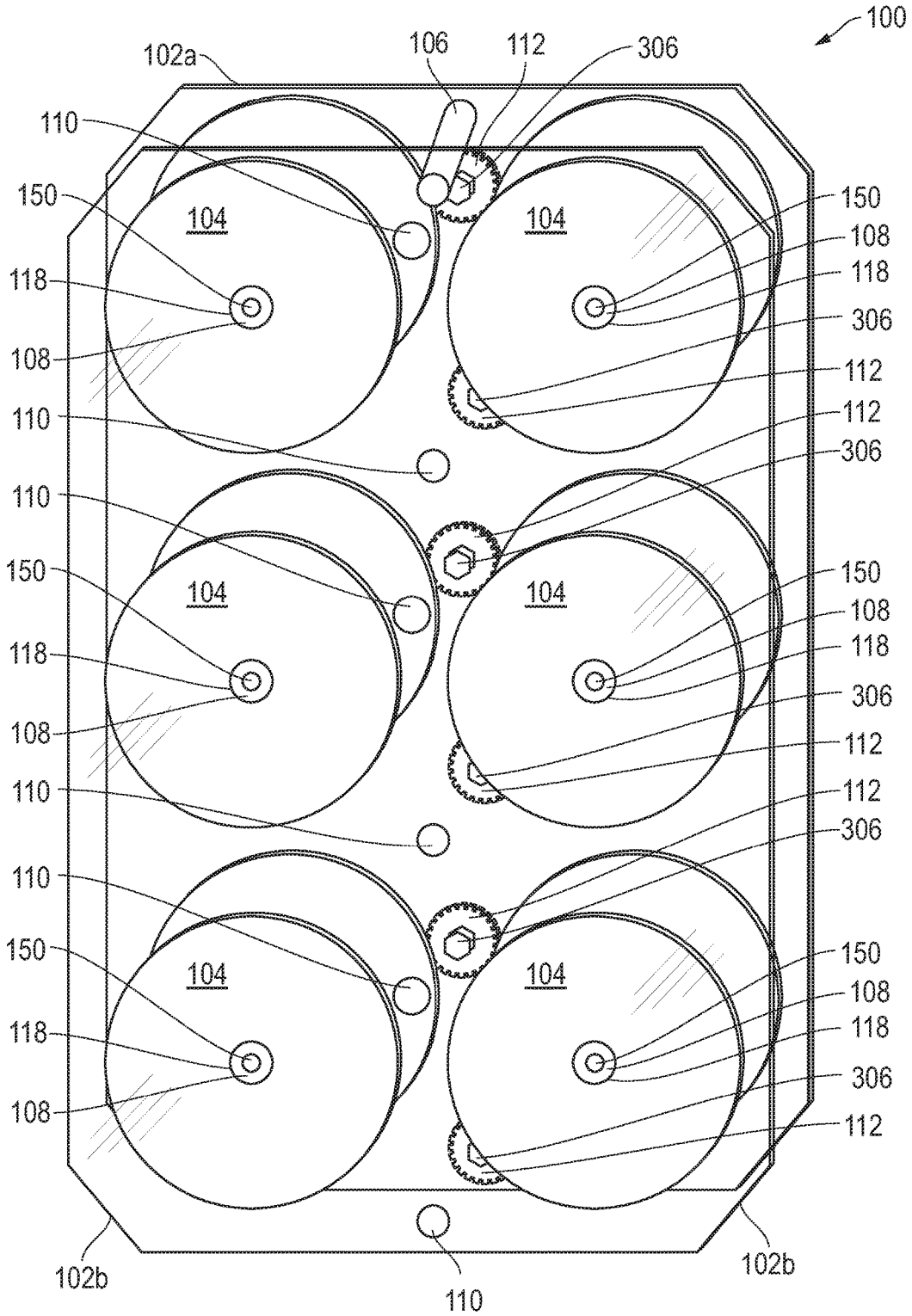
Figure 2:
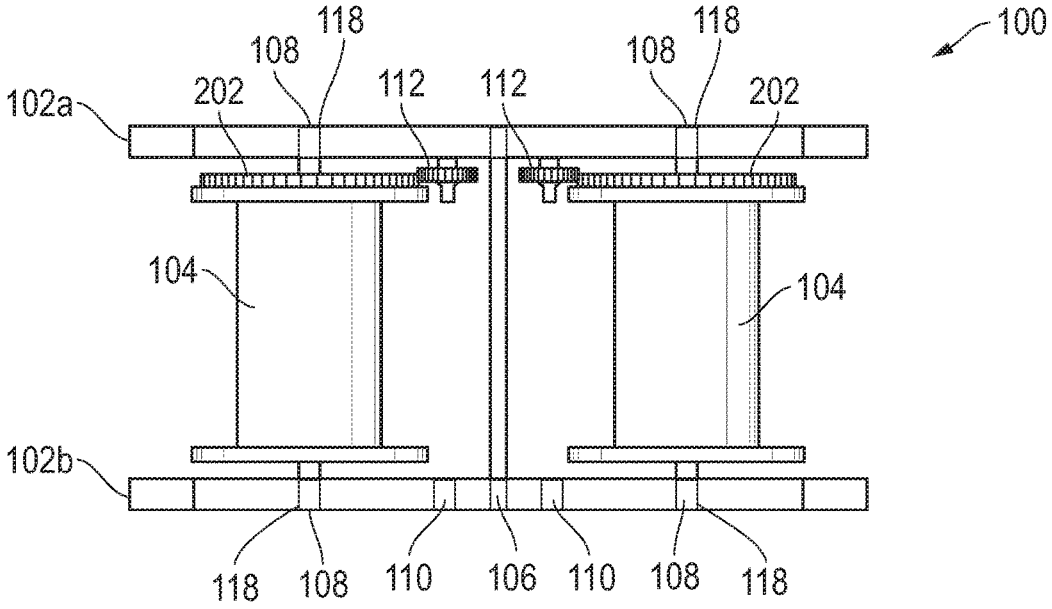
FIG. 2 is a top view of a power driven circuit wire box according to one embodiment of the invention.
Figure 3:
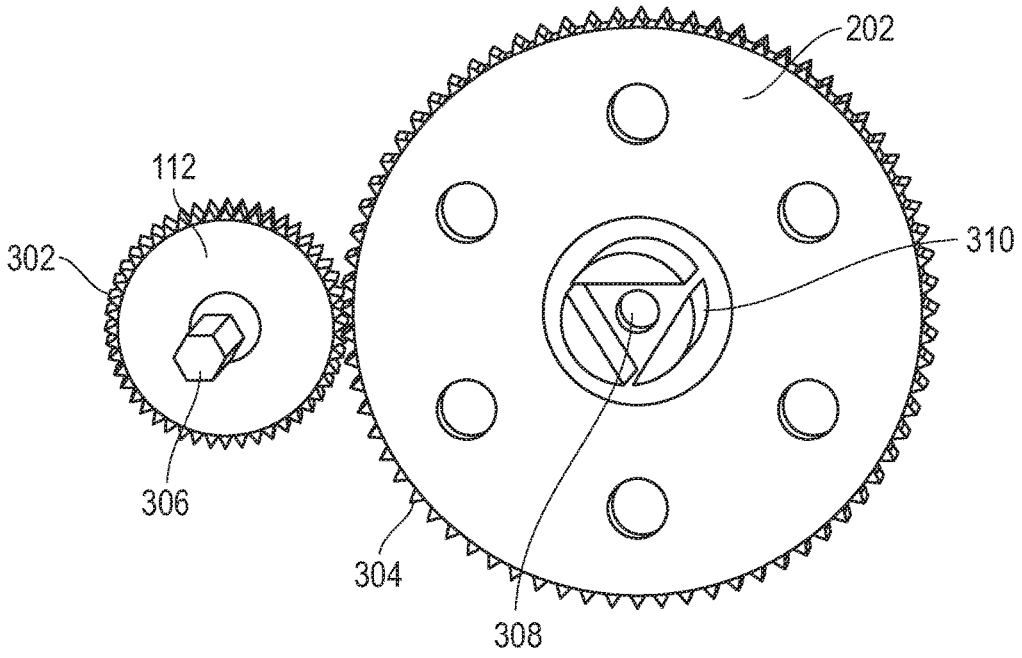
FIG. 3 is a top view of the unassembled spool and power gears of a power driven circuit wire box according to one embodiment of the invention.
Figure 4:
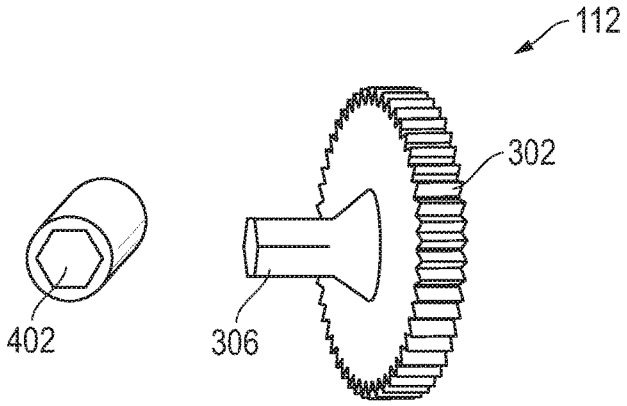
FIG. 4 is a perspective view of the socket and power gear of a power driven circuit wire box according to one embodiment of the invention.

The following discussion is presented to enable a person skilled in the art to make and use the present invention. The general principles described herein may be applied to embodiments and applications other than those specifically detailed below without departing from the spirit and scope of the present invention. Therefore, the present invention is not intended to be limited to the embodiments expressly shown, but is to be accorded the widest possible scope of invention consistent with the principles and features disclosed herein.

Referring now to FIGS. 1-9, various embodiments of a power driven circuit wire box are shown. In one embodiment, the power driven circuit wire box 100 includes two plates 102*a* and 102*b* separated by a shaft 108 or shafts 108, each designed to hold individual spools 104. In one embodiment, the plates 102 *a-b* are transparent or clear, however, a wide variety of plates may be used without detracting from the spirit of the invention. The plates 102*a-b* may be rectangular in shape, rectangular with rounded ends, rectangular with angled ends, or a wide variety of shapes may be implemented without detracting from the spirit of the invention. The power driven circuit wire box 100 includes a support bar 106, or braces or multiple support bars 106, for structural support and to act as a handle to carry the power driven circuit box 100. The shafts 108 and support bar 106 may be fixedly attached or removably attached to the plates 102*a-b*. In one embodiment, the shafts 108 and the support bars 106 are attached to the plates 102*a-b* through a washer and bolt 150. In one embodiment, the power driven circuit wire box 100 includes two (2) shafts 108, however, a wide variety of amount of shafts may be included without detracting from the spirit of the invention, including but not limited to four (4) or six (6) shafts. Each shaft 108 is attached to a spool gear 202 that sits flush with one of the plates 102*a-b*. In one embodiment, a washer is located between the spool gear 202 and the plate 102*a*. The spool gear 202 includes an opening 308 with a diameter equal to or greater than the diameter of the shaft 108, thus allowing the spool gear 202 to either attach to the shaft 108 or to rotate freely around the shaft 108. Extending perpendicularly from the surface of the spool gear 202 are fingers 310 or pins or arms that fit through the arbor of a spool 104. In one embodiment, the spool gear 202 is configured to attach to a plastic spool 104, however, a wide variety of configurations are available to attach to spools of different materials without detracting from the spirit of the invention. The orientation and size of these finger 310 is such that they fit multiple common styles of spool 104 arbor design without modification. In one embodiment, the fingers 310 are tapered to allow for connection to a variety of spool arbor sizes. In another embodiment, the spool gear 202 and spool 104 are fixedly attached or are formed from a single, continuous material. In another embodiment, the spool gear 202 attaches to prior art spools 104. In one embodiment the spool gear 202 is manufactured from a plastic material, however a wide variety of materials may be used to manufacture the spool gear without detracting from the spirit of the invention, including but not limited to metal.

In one embodiment, the spool 104 is rotatably attached to the shaft 108. In another embodiment, the shaft 108 is rotatably attached to the plates 102*a-b*. A wide variety of attachment mechanism may be implemented to attach the shaft 108 and spool 104 or the shaft 108 and plates 102*a-b* including, but not limited to, a lubricant or a bearing 118, without detracting from the spirit of the invention.

Also attached to one of the plates 102*a-b* is a smaller shaft 702 that extends partway into the interior of the power driven circuit wire box 100. The smaller shaft 702 is attached to a power gear 112 of significantly smaller diameter than the spool gear 202. The smaller power gear 112 includes comparable tooth pitch to the larger spool gear 202. One face of the power gear 112 is flush with the plate 102*a*, or separated by a thin bearing, and the opposite face has an extension 306. In one embodiment, the extension 306 takes a hexagonal form. The hexagonal extension 306 accepts and may be driven by common socket 402 or nut driver tools. In another embodiment, the extension 306 takes a rectangular form. A wide variety of extension 306 forms may be implemented without detracting from the spirit of the invention.

Figure 5:
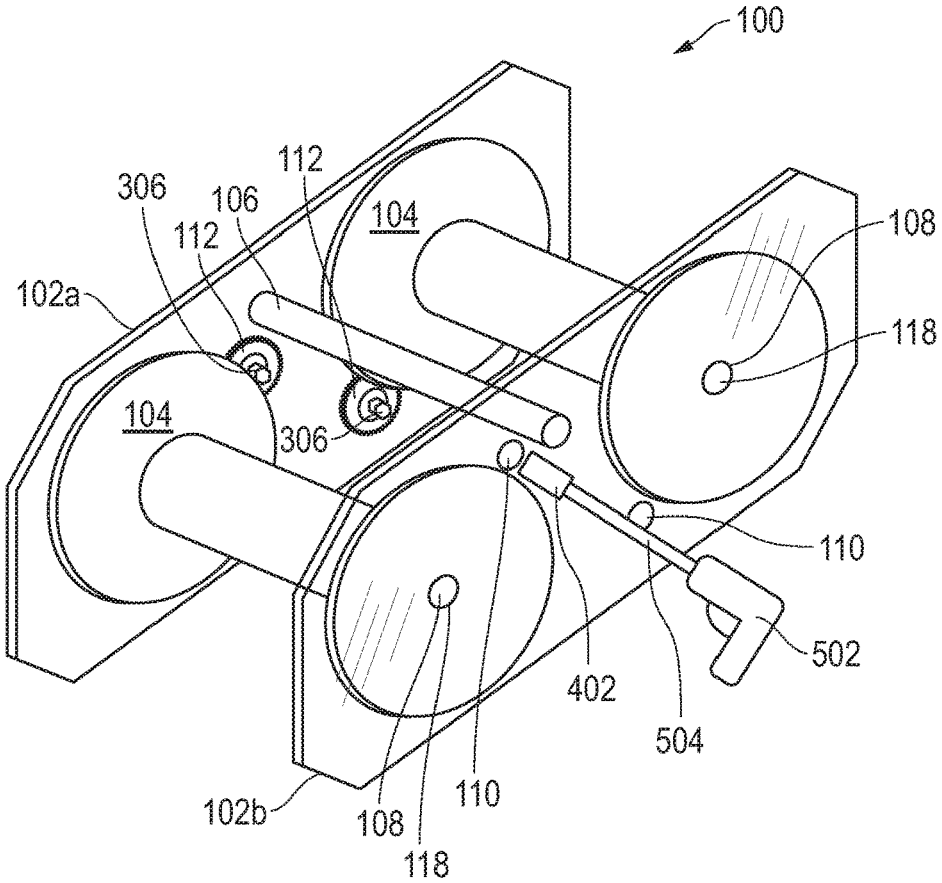
FIG. 5 is a perspective view of a power tool and a power driven circuit wire box according to one embodiment of the invention.
Figure 6:
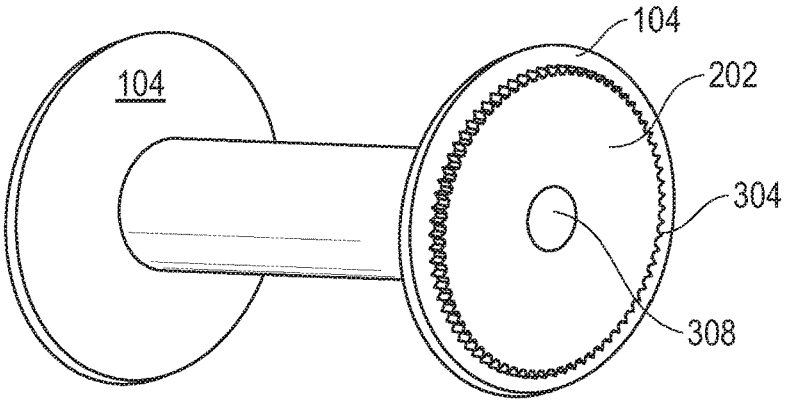
FIG. 6 is a top view of a spool and spool gear of a power driven circuit wire box according to one embodiment of the invention.
Figure 7:
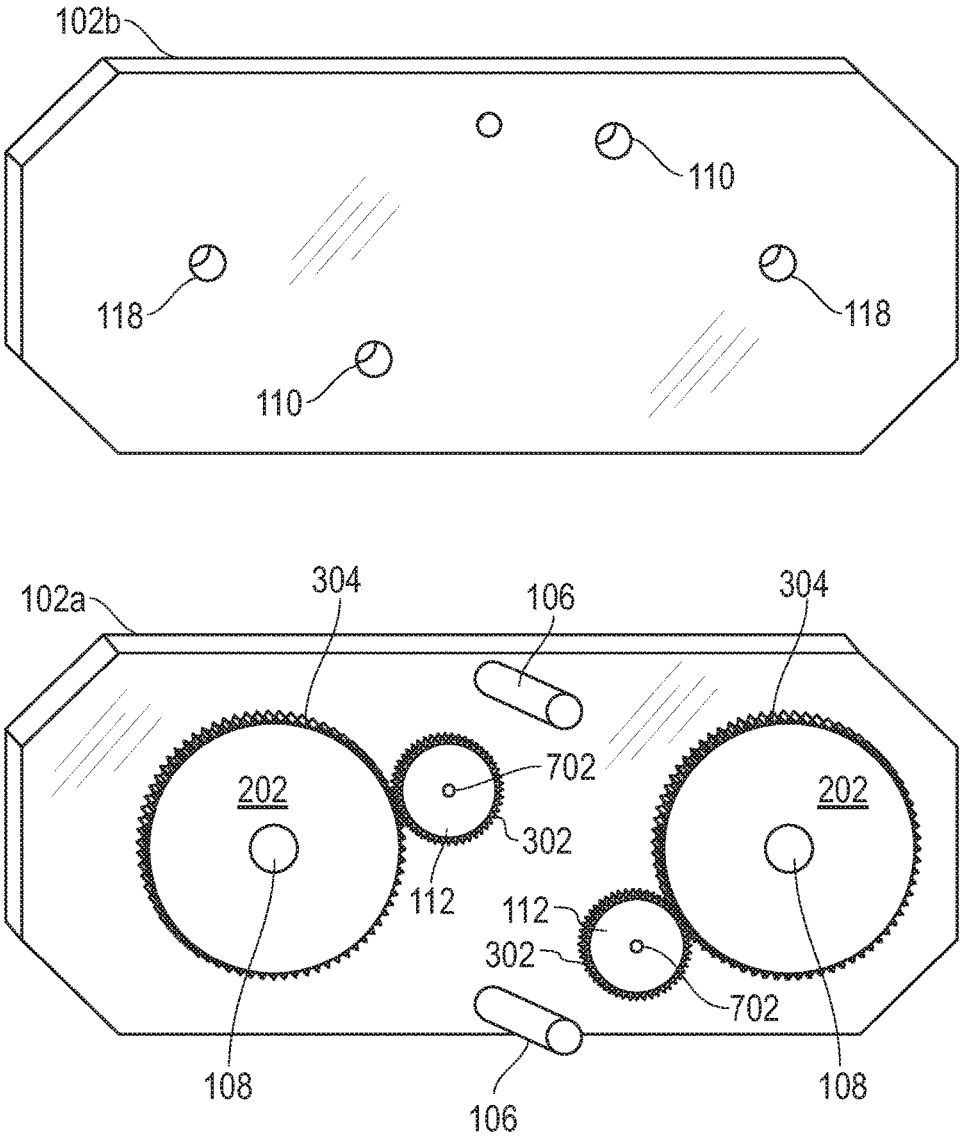
FIG. 7 is a top view of the power driven circuit wire box dismantled to one embodiment of the invention.
Figure 8:
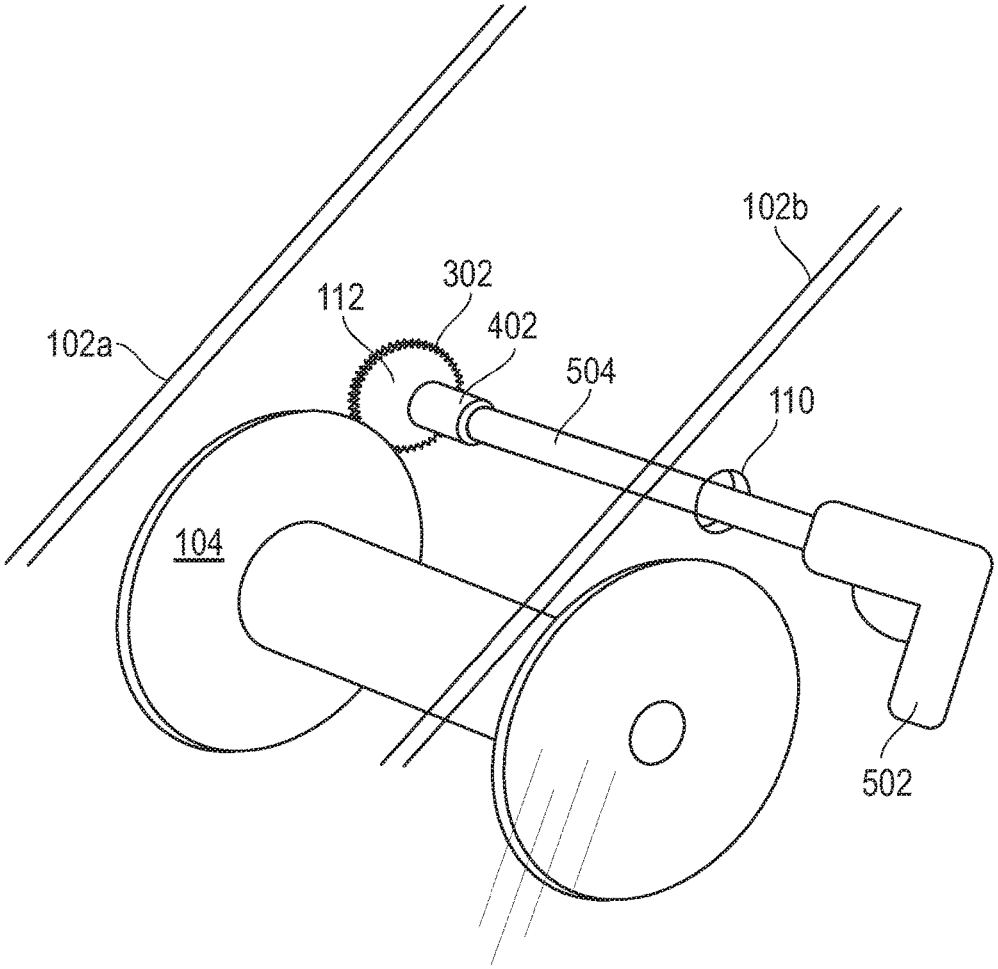
FIG. 8 is a perspective view of a power tool engaging a power driven circuit wire box according to one embodiment of the invention.

The location of the smaller shaft 702 is such that teeth 302 on the power gear 112 mesh with the teeth 304 of the larger spool gear 202. An access hole 110 is present in the plate 102*b* opposite the power gear 112 and on the axis of the extension 306 on the smaller power gear 112. When a power tool 502 is fitted with a socket extension 504 and the socket 402 matching the extension 306 on the power gear 112, socket 402 and socket extension 504 are inserted through access hole 110. The power tool 502 is used to apply torque to the small power gear 112, which in turn which transfers its rotational movement to the larger spool gear 202 and then to the spool 104. An example of one embodiment of a power tool 502 in contact with the power driven circuit wire box 100 is shown in FIG. 5. The torque applied to the larger spool gear 202 is transferred through the fingers 310 to the spool 104, allowing for easy payoff or take-up of the wire contained on the spool 104. In one embodiment, the power gear 112 and spool gear 202 do not impede the manually recovery of excess wire when necessary. This assembly may be repeated in the power driven circuit wire box 100 as many times as desired to allow for powered control for all spools 104 in the power driven circuit wire box 100. In one embodiment, the power tool 502 is a commercially available power drill.

The power driven circuit wire box 100 allows the operator to choose any payoff orientation desired. For storage and transportation purposes, the power driven circuit wire box 100 may be stacked in a wide variety of positions, include on its side. The power driven circuit wire box 100 open design allows for easy viewing and recognition of the material contained on the spools.

In one embodiment, the plate 102*a* is fixedly attached to the shaft 108 and the smaller shaft 702. The attachment mechanism include, but are not limited to, the washer and bolt 150. In another embodiment, the plate 102*a* and the shaft 108 and smaller shaft 702 are formed from a continuous piece of material.

In one embodiment, multiple spool gears 202 are interconnected to allow for rotational movement provided by a single smaller power gear 112. In this embodiment, the power tool 502 may simultaneously power all of the spools 104 contained with the power driven circuit wire box 100. In another embodiment, each spool gear 202 is connected to a smaller power gear 112. In this embodiment, each spool 104 may be individually driven by a power tool 502. The size of the power driven circuit wire box 100 may vary without detracting from the spirit of the invention. In one embodiment, the size of the power driven circuit wire box 100 allows for a large variety of spool 104 sizes to be contained within the power driven circuit wire box 100. In another embodiment, the power driven circuit wire box 100 size is specifically designed to match the size of a specific spool 104.

In one embodiment, a support bar 106 is attached to the plates 102*a-b* above the spools 104. This support bar 106 may be used as a handle to grab and move the power driven circuit wire box 100. In one embodiment, the power driven circuit wire box 100 includes two plates 102*a-b* with the shaft 108, spool gear 202, and power gear 112 provided between the plates 102*a-b*. In this embodiment, one of the plates 102*b* is removeably attached to the shaft 108 to allow for the operator to provide and remove spools 104 as needed. In another embodiment, a single plate 102*a* is provided attached to the shaft 108. In this embodiment, a cap is attached to the end opposite the end of the shaft 108 attached to the plate 102*b*. The cap diameter is greater than the arbor of the spool 104 and the spool gear 202, thus attaching the spool 104 and spool gear 202 to the shaft 108.

Although the invention is described herein with reference to specific embodiments, various modifications and changes can be made without departing from the scope of the invention as set forth in the claims below. Accordingly, the specification and figures are to be regarded in an illustrative rather than a restrictive sense, and all such modifications are intended to be included within the scope of the invention. Any benefits, advantages, or solutions to problems that are described herein with regard to specific embodiments are not intended to be construed as a critical, required, or essential feature or element of any or all the claims.

From time-to-time, the invention is described herein in terms of these example embodiments. Description in terms of these embodiments is provided to allow the various features and embodiments of the invention to be portrayed in the context of an exemplary application. After reading this description, it will become apparent to one of ordinary skill in the art how the invention can be implemented in different and alternative environments. Unless defined otherwise, all technical and scientific terms used herein have the same meaning as is commonly understood by one of ordinary skill in the art to which this invention belongs.

The preceding discussion is presented to enable a person skilled in the art to make and use the invention. The general principles described herein may be applied to embodiments and applications other than those detailed below without departing from the spirit and scope of the invention as defined by the appended claims. The invention is not intended to be limited to the embodiments shown, but is to be accorded the widest scope consistent with the principles and features disclosed herein.

In addition, while a particular feature of the invention may have been disclosed with respect to only one of several embodiments, such feature may be combined with one or more other features of the other embodiments as may be desired. It is therefore, contemplated that the claims will cover any such modifications or embodiments that fall within the true scope of the invention.

The various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one", "one or more" or the like; and adjectives such as "conventional", "traditional", "normal", "standard", "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more", "at least", "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Unless stated otherwise, terms such as "first" and "second" are used to arbitrarily distinguish between the elements such terms describe. Thus, these terms are not necessarily intended to indicate temporal or other prioritization of such elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in the field or any related fields are intended to be within the scope of the following claims.

What is claimed is:

1. An apparatus for the dispensing and retraction of wire or cable, the apparatus comprising:

a first and second plate;

at least one shaft attached to the first plate and the second plate, wherein the first and second plate and the at least one shaft form a box absent of a top, a bottom, and both sides and wherein the wire or cable is dispensed or retracted through the top, bottom, or sides;

a spool gear attached to the shaft;

a power gear shaft attached to the first or second plate; and a power gear attached to the power gear shaft and in mesh with the spool gear;

wherein when the power gear is rotated, the spool gear is rotated; wherein the power gear comprises an extension for attachment to a rotational power source and wherein a hole is provided in the opposite plate on the same axis as the extension allowing a rotational tool to be inserted in to the hole and attaching to the extension.

2. The apparatus of claim 1, wherein the first and second plates are formed from plastic.

3. The apparatus of claim 1, wherein the first and second plastic plates are clear.

4. The apparatus of claim 1 further comprising a single brace attached to the first plate and the second plate.

5. The apparatus of claim 4, wherein the brace is a handle for the apparatus.

6. The apparatus of claim 1, wherein the at least one shaft is at least two shafts.

7. The apparatus of claim 6, wherein the at least two shafts is at least four shafts.

8. The apparatus of claim 1, wherein the spool gear is rotatably attached to the shaft.

9. The apparatus of claim 8, wherein the spool gear comprises a bearing in rotational attachment to the shaft.

10. The apparatus of claim 8 further comprising a lubricant between the spool gear and the shaft.

11. The apparatus of claim 1, wherein the at least one shaft is rotatably attached to the first and second plates.

12. The apparatus of claim 11, wherein the shaft comprises a bearing in rotational attachment to the first plate.

13. The apparatus of claim 12, wherein the shaft comprises a bearing in rotational attachment to the second plate.

14. The apparatus of claim 11 further comprising a lubricant between the shaft and the first and second plates.

15. The apparatus of claim 1, wherein the first plate is removably attached to the shaft.

16. The apparatus of claim 1, wherein the first plate is fixedly attached to the shaft and the second plate is removably attached to the shaft.

17. The apparatus of claim 16, wherein the first plate and the shaft are formed from a continuous material.

18. A system for the dispensing and retraction of wire or cable, the system comprising:

a first and second plate;

at least one shaft fixedly attached to the first plate and removably attached to the second plate, wherein the first and second plate and the at least one shaft form a box absent of a top, a bottom, and both sides and wherein the wire or cable is dispensed or retracted through the top, bottom, or sides;

a spool attached to the shaft, wherein the spool rotates around the shaft;

a power gear shaft attached to the first or second plate;

a spool gear attached to the spool; and a power gear attached to the power gear shaft and in mesh with the spool gear;

wherein when the power gear is rotated, the spool gear is rotated and the spool is rotated; wherein the power gear comprises an extension for attachment to a rotational power source and wherein a hole is provided in the opposite plate on the same axis as the extension allowing a rotational tool to be inserted in to the hole and attach to the extension, wherein the rotational tool rotates the power gear which rotates the spool gear.

19. The system of claim 18, wherein the spool gear is fixedly attached to the spool.

20. The system of claim 18, wherein the spool gear and the spool are formed from a continuous material.

21. The system of claim 18, wherein the rotational tool is a power tool.

22. The system of claim 21, wherein the power tool is a power drill.

* * * * *